US009145673B1

(12) United States Patent
Dantzer

(10) Patent No.: US 9,145,673 B1
(45) Date of Patent: Sep. 29, 2015

(54) DECK CLIP AND MODULAR DECK ASSEMBLY

(71) Applicant: Hugh A. Dantzer, Edmonton (CA)

(72) Inventor: Hugh A. Dantzer, Edmonton (CA)

( * ) Notice: Subject to any disclaimer, the term of this patent is extended or adjusted under 35 U.S.C. 154(b) by 0 days.

(21) Appl. No.: 14/544,101

(22) Filed: Nov. 25, 2014

(51) Int. Cl.

| | |
|---|---|
| ***E04B 2/30*** | (2006.01) |
| ***E04B 1/41*** | (2006.01) |
| ***F16B 12/20*** | (2006.01) |
| ***E04B 1/00*** | (2006.01) |
| ***E04F 15/02*** | (2006.01) |
| ***E04F 15/022*** | (2006.01) |
| *E04B 1/38* | (2006.01) |

(52) U.S. Cl.
CPC . *E04B 1/40* (2013.01); *E04B 1/003* (2013.01); *E04F 15/022* (2013.01); *E04F 15/02183* (2013.01); *F16B 12/20* (2013.01); *E04B 2001/405* (2013.01)

(58) Field of Classification Search
CPC ..... E04B 2002/7475; E04B 2002/7462; E04B 2/30; F27D 1/144; F16B 15/0015; F16B 15/004; F16B 15/0023; F16B 15/003; F16B 15/0046; F16B 15/0053; F16B 15/0076; F16B 15/007; E04F 13/0848; E04F 13/081
USPC ..... 52/483.1, 489.1, 489.2, 509–510, 512, 52/702, 704, 712, 714, 715, 506.05, 52/506.06; 411/461, 470; 24/295, 329, 24/67.1, 67.3, 37; 248/497
See application file for complete search history.

(56) References Cited

U.S. PATENT DOCUMENTS

| | | | | | |
|---|---|---|---|---|---|
| 1,626,589 | A * | 5/1927 | Alber | 52/367 |
| 1,898,364 | A * | 2/1933 | Gynn | 52/512 |
| 3,189,137 | A * | 6/1965 | Harris | 52/765 |
| 3,331,180 | A * | 7/1967 | Vissing et al. | 52/714 |
| 3,522,923 | A * | 8/1970 | Charpentier | 52/489.2 |
| 4,272,938 | A * | 6/1981 | Seipos | 52/509 |
| 4,466,225 | A * | 8/1984 | Hovind | 52/481.1 |
| 4,498,272 | A * | 2/1985 | Adams | 52/714 |
| 4,616,462 | A * | 10/1986 | Abendroth | 52/509 |
| 4,620,403 | A * | 11/1986 | Field | 52/480 |
| 4,641,474 | A * | 2/1987 | Cannarsa | 52/514 |
| 4,703,601 | A * | 11/1987 | Abendroth | 52/509 |
| 4,844,651 | A * | 7/1989 | Partridge | 403/386 |
| 4,991,373 | A * | 2/1991 | Shaub | 52/715 |
| 5,152,117 | A * | 10/1992 | Wynar | 52/712 |
| 5,211,521 | A * | 5/1993 | Page | 411/508 |
| 5,502,942 | A * | 4/1996 | Gras et al. | 52/511 |
| 5,619,836 | A * | 4/1997 | Rouch et al. | 52/715 |
| 5,642,597 | A * | 7/1997 | Hendrickson | 52/715 |
| 6,131,361 | A * | 10/2000 | Murphy | 52/712 |
| 6,237,295 | B1 * | 5/2001 | Ballard | 52/589.1 |
| 6,883,880 | B2 * | 4/2005 | Flores | 312/140.4 |
| 7,178,305 | B2 * | 2/2007 | Petrova | 52/715 |
| D589,334 | S * | 3/2009 | Hotchkiss, III | D8/382 |
| 7,774,995 | B1 * | 8/2010 | Zidar, Jr. | 52/127.2 |
| 7,789,359 | B2 * | 9/2010 | Chopp, Jr. | 248/211 |
| 8,011,153 | B2 * | 9/2011 | Orchard | 52/489.1 |
| 2001/0015042 | A1 * | 8/2001 | Ballard | 52/589.1 |

(Continued)

*Primary Examiner* — Beth Stephan
(74) *Attorney, Agent, or Firm* — George A. Seaby

(57) ABSTRACT

A deck clip for connecting prefabricated deck tiles to sleepers includes a planar base for connection to a sleeper, spaced apart barbs on opposite sides of the top surface of the base for penetrating the corners of furring strips of two adjacent first floor tiles, and an inverted L-shaped hook integral with and extending upwardly from one end of the base, the top arm of the hook extending away from the base defining a ledge for engaging the corners of furring strips of two additional floor tiles adjacent to the first two floor tiles.

5 Claims, 7 Drawing Sheets

(56) References Cited

U.S. PATENT DOCUMENTS

2002/0174618 A1* 11/2002 Carroll ..... 52/520
2003/0121226 A1* 7/2003 Bolduc ..... 52/391
2004/0237443 A1* 12/2004 Haley et al. ..... 52/545
2007/0044421 A1* 3/2007 Nguyen ..... 52/698
2008/0120943 A1* 5/2008 Lehane et al. ..... 52/749.1
2010/0205895 A1* 8/2010 Orchard ..... 52/712

* cited by examiner

DECK CLIP AND MODULAR DECK ASSEMBLY

FIELD OF THE INVENTION

This invention relates to a deck clip and a modular deck assembly including the deck clip.

BACKGROUND OF THE INVENTION

Modular decks and clips used as connectors in such decks are by no means new. An example of a modular deck is described in U.S. Pat. No. 6,209,267, which issued to Hugh A. Dantzer on Apr. 3, 2001. The patents listed on the cover page of the Dantzer patent disclose modular deck systems and connectors used in the construction of such systems. In general, the modular deck systems are somewhat complicated and rely on specially designed connectors for assembling the systems. The inventor found that there was a need for a deck system which could be quickly assembled without specially designed planks and/or connectors.

An object of the present invention is to meet the above-defined need by providing a relatively simple deck clip and a modular deck assembly incorporating the clip. The clip of the present invention enables the quick construction of a deck assembly without a large number of screws or other fasteners.

SUMMARY OF THE INVENTION

According to one aspect, the present invention provides a deck clip for use in assembling a deck, which includes deck tiles defined by floor boards connected to furring strips mounted on sleepers, comprising a planar base; holes in the base for receiving fasteners for connecting the clip to a sleeper; an inverted L-shaped hook including a web extending upwardly from one end of the base and a planar ledge extending horizontally from the top end of the web in a direction away from the base for engaging the furring strips of two adjacent deck tiles; and barbs extending upwardly from the base on each side of a longitudinal axis of the base for engaging the furring strips of third and fourth deck tiles.

According to another aspect, the present invention provides a deck assembly comprising:

at least three parallel sleepers extending longitudinally of the assembly, including two side sleepers and a central sleeper centered between said side sleepers;

two parallel rows of deck tiles connected to said sleepers, each deck tile including furring strips and floor boards connected to said furring strips and extending perpendicular thereto;

deck clips for connecting the four corners of adjacent deck tiles to the central sleeper, each deck clip including a planar base; holes in the base for receiving fasteners for connecting the clip to a sleeper; an inverted L-shaped hook including a web extending upwardly from one end of the base and a planar ledge extending horizontally from the top end of the web in a direction away from the base for engaging the furring strips of two adjacent deck tiles; and barbs extending upwardly from the base on each side of a longitudinal axis of the base for engaging the furring strips of third and fourth deck tiles.

DETAILED DESCRIPTION OF THE DRAWINGS

Figure 1:
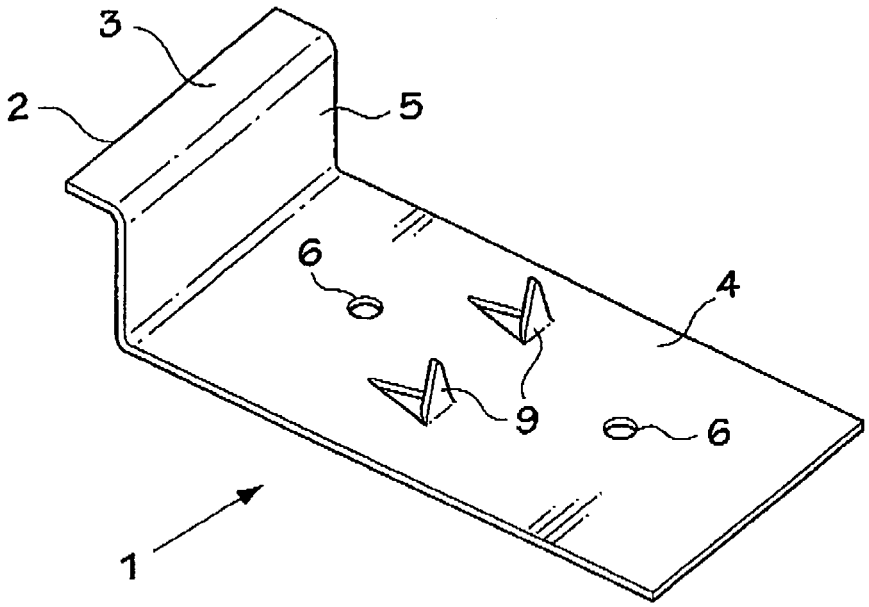
FIG. 1 is an isometric view of a deck clip in accordance with the invention.
Figure 2:
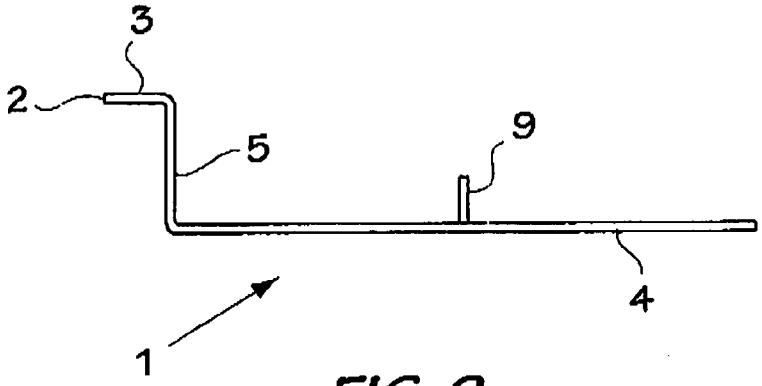
FIG. 2 is a side view of the deck clip of FIG. 1.

Referring to FIGS. 1 and 2, the deck clip indicated generally at 1 is defined by a rectangular strip of material, one end 2 of which is bent to form an inverted L-shaped hook, which includes a top ledge 3, which is connected to a large rectangular base 4 by a vertical web 5. The ledge 3 extends horizontally from the top end of the web 5 in a direction away from the base 4. Holes 6 are provided in the base for receiving fasteners, which connect the clip 1 to a sleeper 7 (FIGS. 6 to 9). Upwardly extending barbs 9 are punched out of the base 4.

Figure 4:
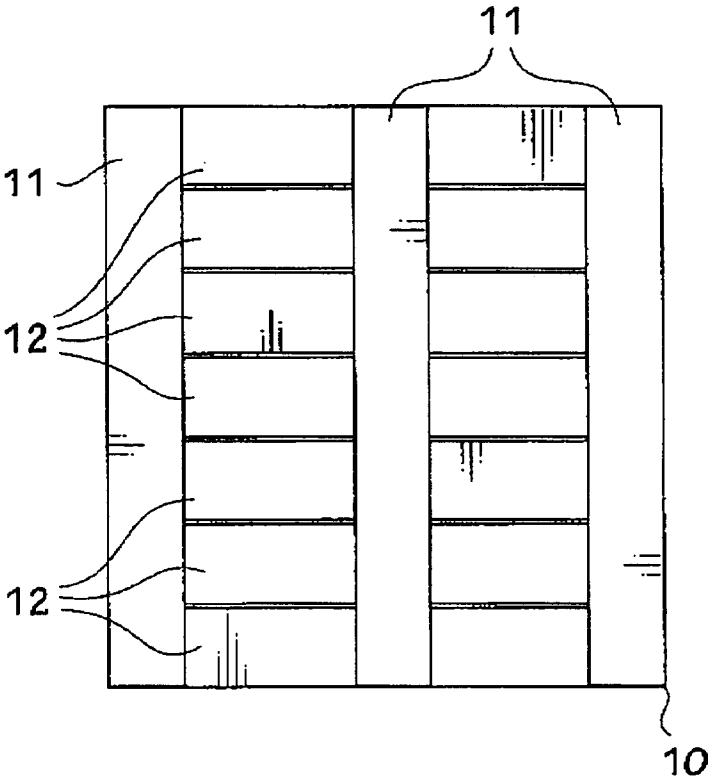
FIG. 4 a bottom view of the deck tile of FIG. 3.
Figure 3:
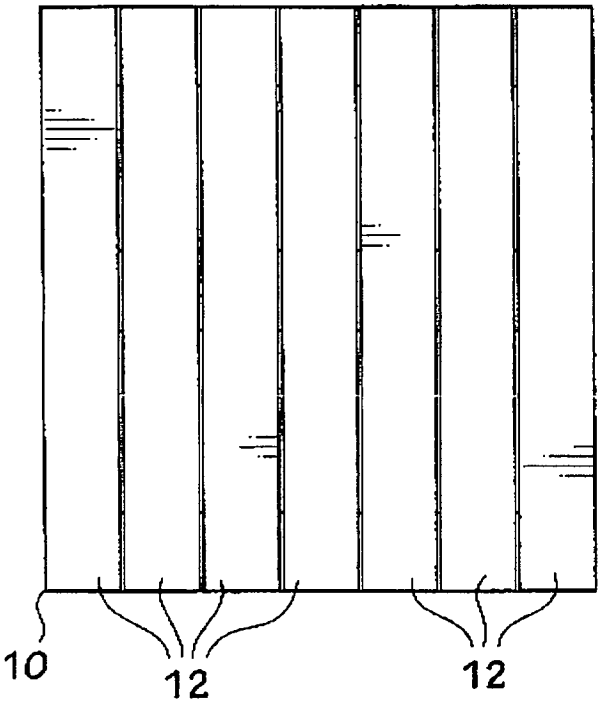
FIG. 3 is a top view of a deck tile used in the modular deck assembly of the present invention.
Figure 5:
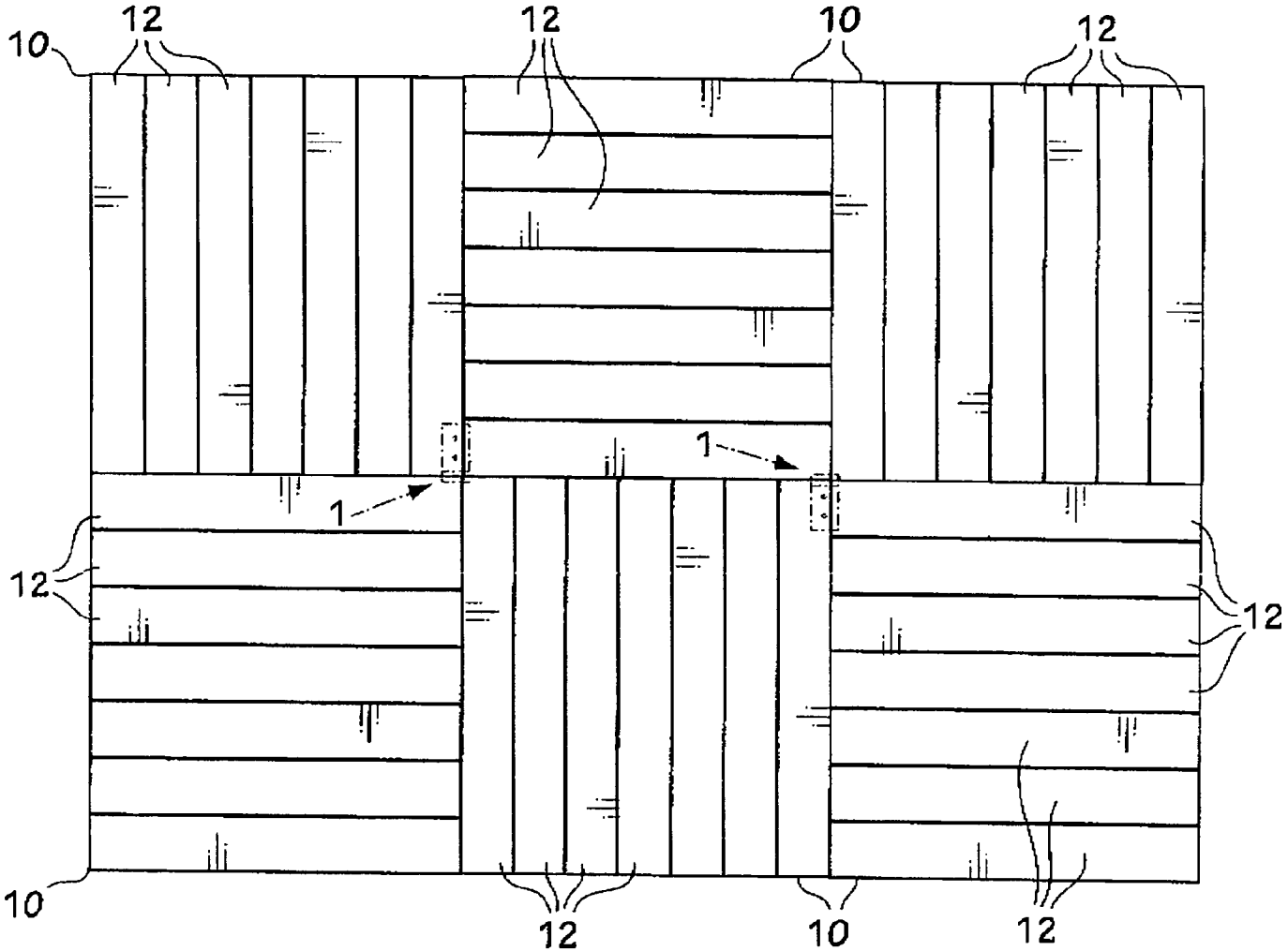
FIG. 5 is a top view of the modular deck assembly constructed using the clip of FIGS. 1 and 2, and the deck tile of FIGS. 3 and 4.
Figure 6:
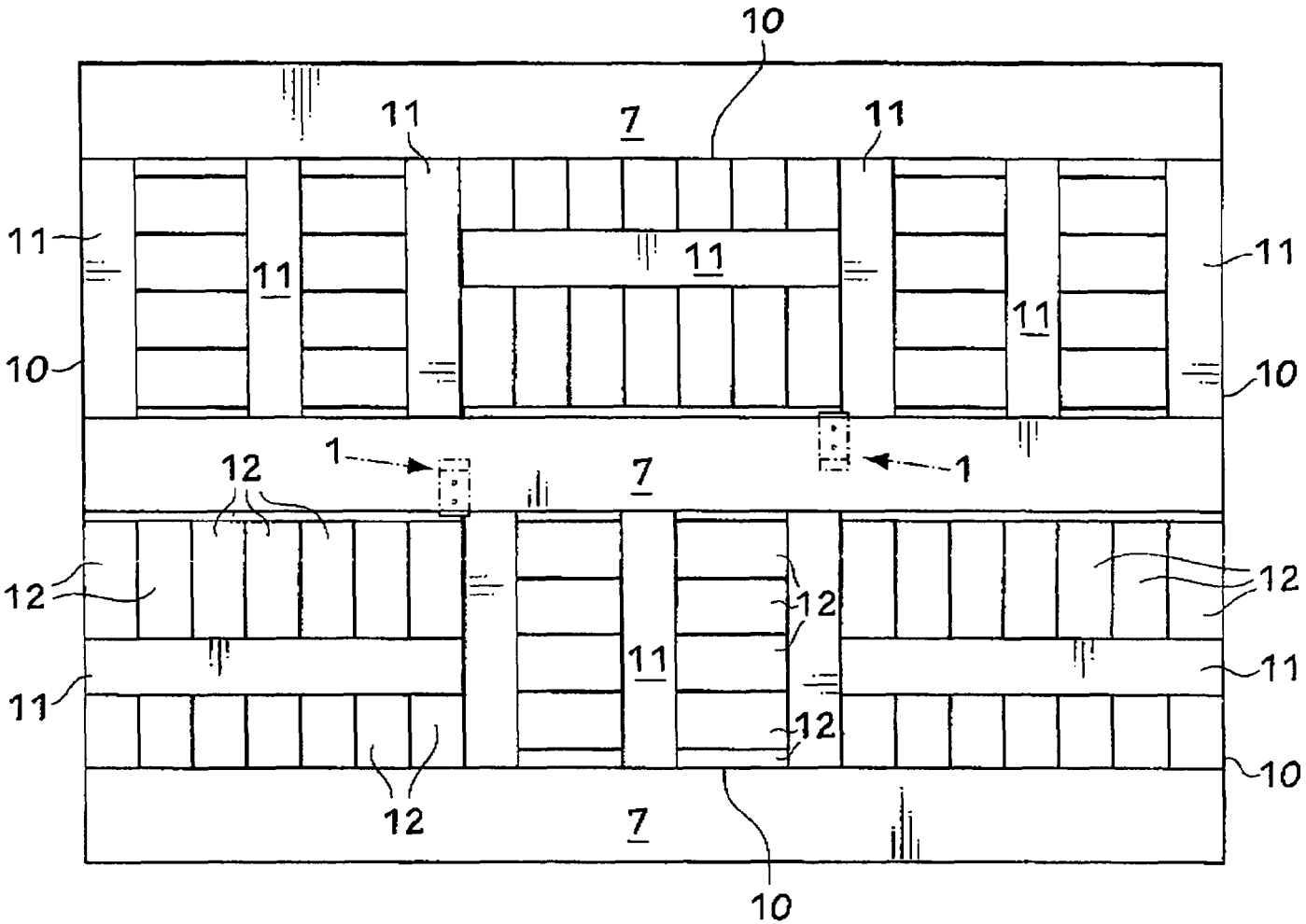
FIG. 6 is a bottom view of the deck assembly of FIG. 5.

The clip is used in combination with pre-assembled deck tiles 10, one of which is illustrated in FIGS. 3 and 4 and sleepers 7 to form the deck illustrated in FIGS. 5 and 6. Each deck tile 10 includes three furring strips 11 and seven 1"×6" floor boards 12 attached to the furring strips with ¼" spacing between the boards. The deck tile 10 is assembled upside down, i.e. the floor boards 12 are placed on a flat surface and the furring strips 11 are nailed to the floor boards 12 using brad nails (not shown), which are not seen when the deck tile 10 is topside up. The furring strips 11 are connected to the ends and centers of the boards 12.

As shown in FIGS. 5 and 6, a deck is quickly and easily assembled using deck clips 1, sleepers 7 and deck tiles 10. The sleepers 7, which can rest directly on the ground or another flat surface, are connected to the bottom sides and center of a rectangular assembly of deck tiles 10 arranged in two abutting rows of three tiles. Of course, the deck can include more or fewer tiles 10. The side edges of the outer furring strips 11 extending longitudinally of the sides of the deck and the outer ends of the furring strips extending laterally of the deck are connected to the outer sleepers 7 using brad nails. The ends of the sleeper 7 extending along the center of the deck are also connected to furring strips 11 using brad nails. The two junctions of four deck tiles 10 on the center line of the deck are connected to the central sleeper 7 using deck clips 1.

The first step in constructing the deck of FIGS. 5 and 6 is to connect the outer sleepers 7 to the outside edges of a row of three deck tiles 10. It will be noted that the deck tiles 10 are at right angles to each other, i.e., the floor boards 12 of one deck tile 10 are at right angles to the floor boards 12 of each adjacent floor tile. However, the floor boards of adjacent deck tiles can extend in the same direction longitudinally or transversely of the deck. For a more pleasing appearance, the floor boards of adjacent deck tiles are perpendicular to each other as shown in FIGS. 5 and 6.

Figure 7:
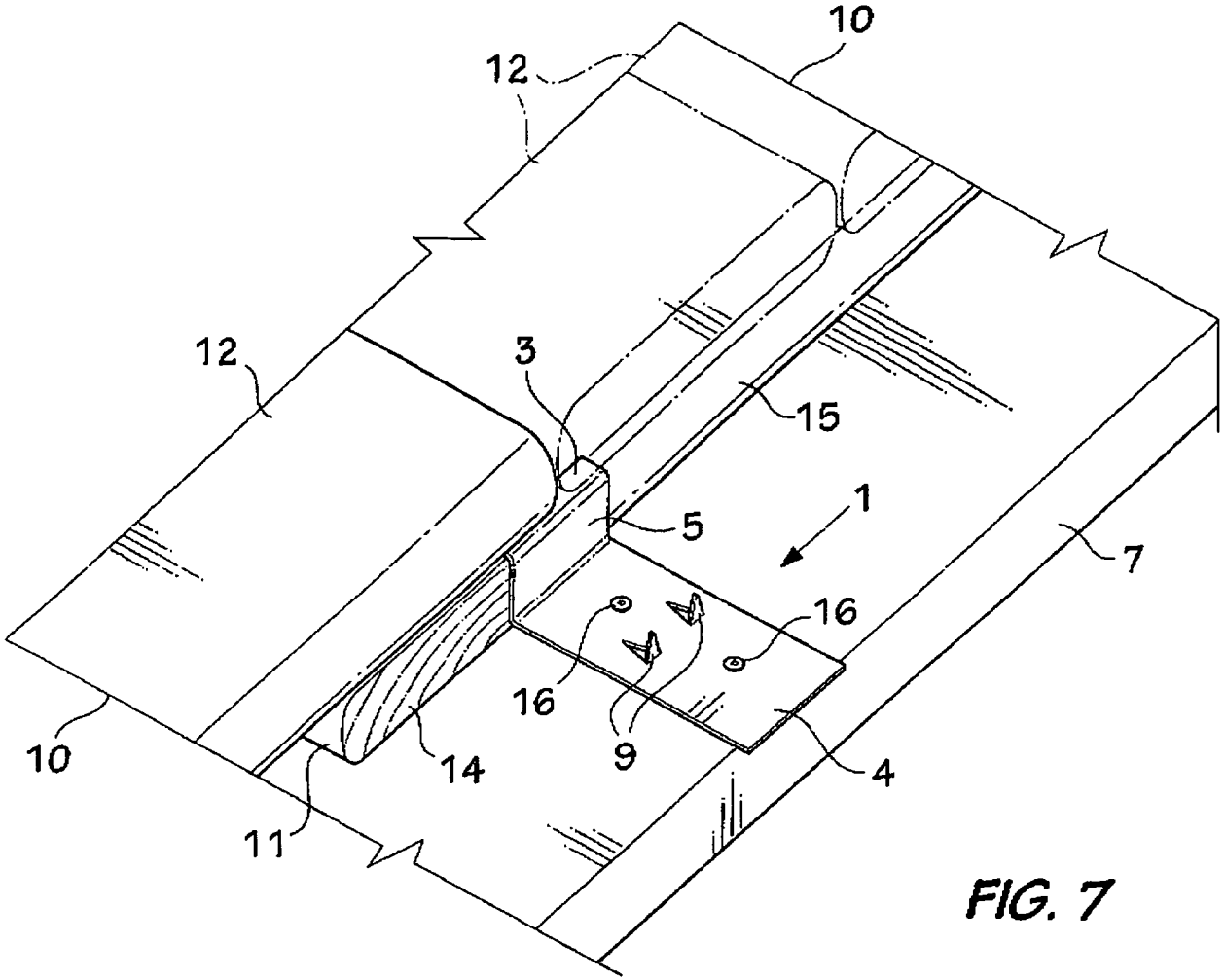
FIGS. 7 to 9 are isometric views of a section of the deck assembly at various stages of construction.
Figure 8:
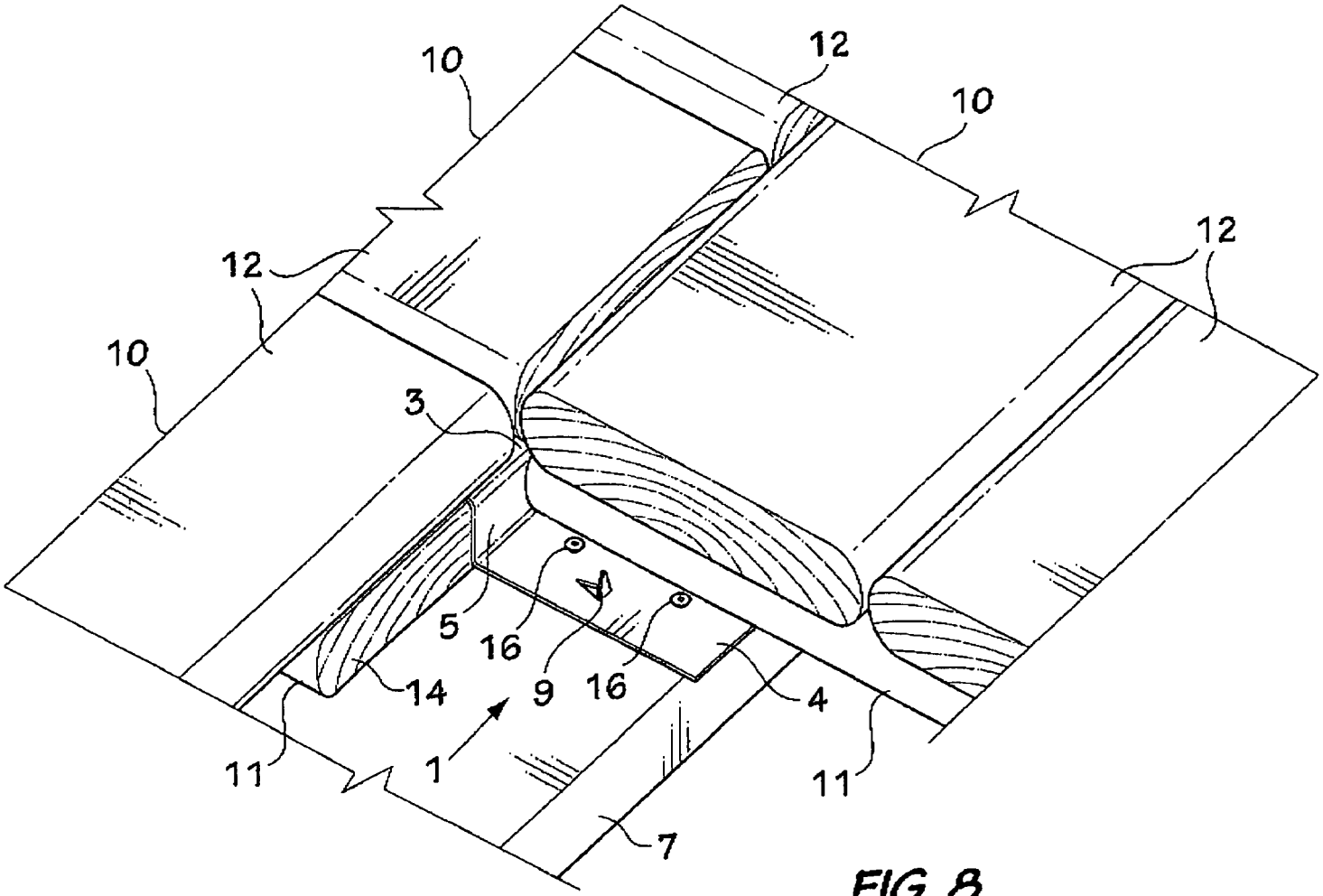
Figure 9:
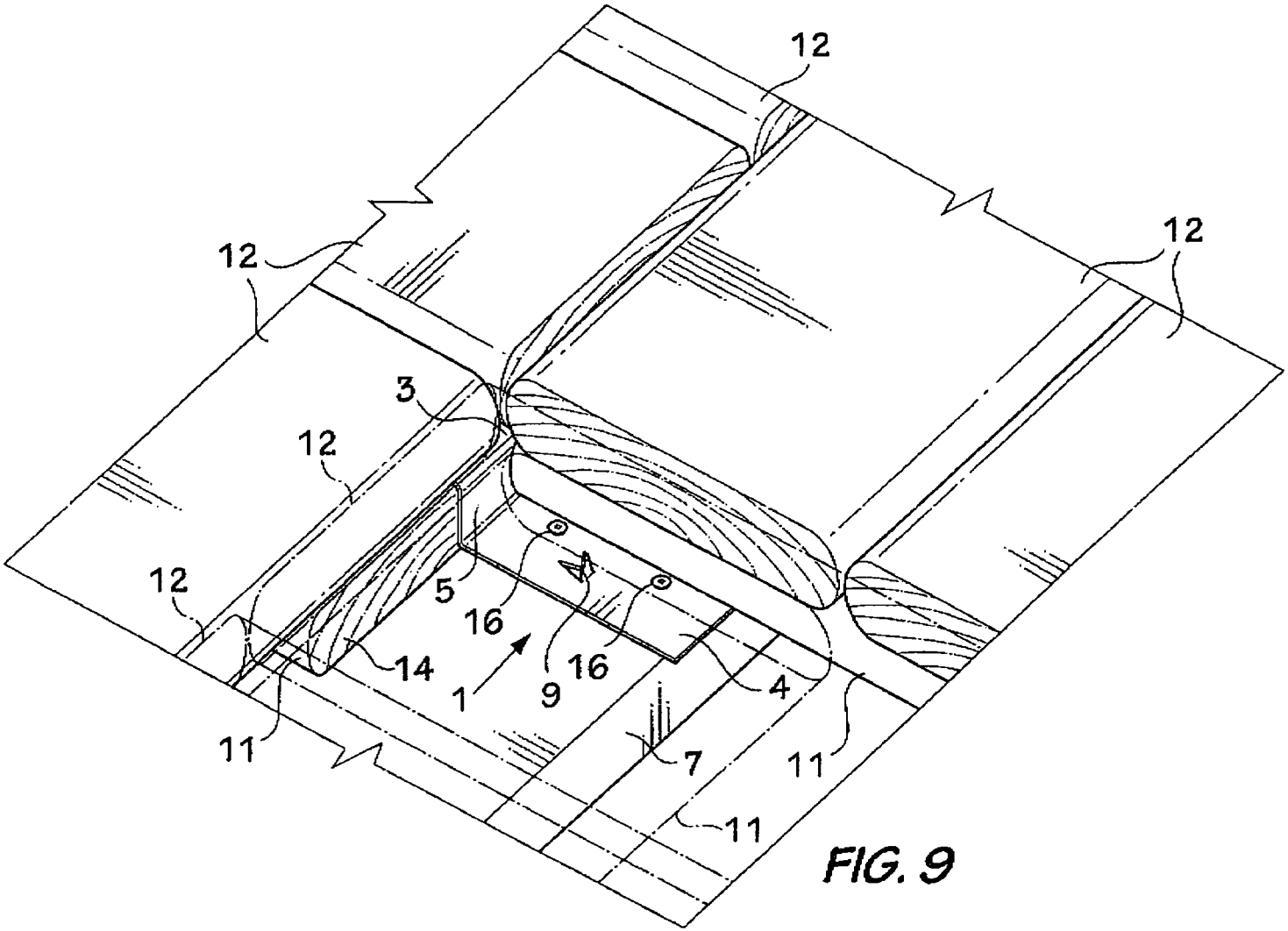

The central sleeper 7 is placed on the ground or another flat surface, and the inner ends of the three aligned deck tiles 10 are placed on the sleeper 7. As shown in FIG. 7, the ledge 3 of a deck clip 1 is slid into a position in which one side of the ledge 3 overlaps the inner end 14 of one furring strip 11 of one deck tile and the side 15 of the furring strip 11 of an adjacent deck tile 10. The clip 1 is then connected to the center sleeper 7 using fasteners in the form of screws 16. A third deck tile 10 (FIG. 8) is placed in a position in which it overlaps approximately one-half of the base 4 of the clip 1. When properly positioned, the floor boards 12 of the third deck tile are aligned with the longitudinal axis of the sleeper 7. The corner of the tile 11 overlapping the clip base 4 is pressed or hammered down so that one of the prongs 9 enters the furring strip 11. A fourth deck tile 10 (FIG. 9) is then placed in position over the deck clip 1 with its floor boards 12 extending perpendicular to the longitudinal axis of the sleeper 7. The corner of the fourth deck tile 10 is then pressed down so that the second prong 9 enters its furring strip 11.

In accordance with another embodiment of the invention the clip and deck tiles can be used to re-surface an existing deck. The floor boards of a deck are removed to expose the joists, and the deck tiles are connected to the exposed joists using the clips described above.

The invention claimed is:

1. A deck clip for use in assembling a deck, the deck including deck tiles defined by floor boards connected to furring strips mounted on parallel sleepers, or for resurfacing an existing deck, the deck including exposed joists, the deck clip comprising a planar base; holes in the base for receiving fasteners for connecting the clip to one of the sleepers or to an exposed joist of an existing deck; an inverted L-shaped hook including a web extending vertically upwardly from one end of the base having a top end spaced from one end of the base and a planar ledge extending horizontally from the top end of the web in a direction away from the base having an outer free end for insertion between the floor boards and furring strips of two adjacent deck tiles and engaging the furring strips of the two adjacent deck tiles; and barbs extending upwardly from the base on each side of a longitudinal axis of the base for engaging and retaining furring strips of third and fourth deck tiles.

2. The deck clip of claim 1, wherein said holes in said base are aligned with the longitudinal axis of the clip for receiving screws for connecting the clip to one of the sleepers or to one, of the exposed joists.

3. A deck assembly comprising:

at least three parallel sleepers extending longitudinally, including two side sleepers and a central sleeper centered between said side sleepers;

two parallel rows of deck tiles connected to said sleepers, each deck tile including furring strips and floor boards connected to said furring strips and extending perpendicular thereto;

deck clips for connecting the four corners of adjacent deck tiles to the central sleeper, each deck clip including a planar base; holes in the base for receiving fasteners for connecting the clip to one of the sleepers; an inverted L-shaped hook including a web extending upwardly from one end of the base having a top end spaced from said one end of the base and a planar ledge extending horizontally from the top end of the web in a direction away from the base, the ledge having an outer free end or insertion between the floor boards and furring strips of two adjacent deck tiles and engaging the furring strips of the two adjacent deck tiles; and barbs extending upwardly from the base on each side of a longitudinal axis of the base for engaging and retaining the furring strips of third and fourth deck tiles.

4. The deck assembly of claim 3, wherein the floor boards of at least one of the deck tiles is perpendicular to the floor boards of one of the adjacent deck tiles.

5. The deck assembly of claim 3, wherein the floor boards of at least one of the deck tiles is parallel to the floor boards of one of the adjacent deck tiles.

* * * * *